US011850840B2

(12) United States Patent
Galkin

(10) Patent No.: US 11,850,840 B2
(45) Date of Patent: Dec. 26, 2023

(54) POP UP CONTROLLER FOR HEAT PRESS

(71) Applicant: Stahls' Inc., Sterling Heights, MI (US)

(72) Inventor: Anton Galkin, Sterling Heights, MI (US)

(73) Assignee: STAHLS' INC., St. Clair Shores, MI (US)

( * ) Notice: Subject to any disclaimer, the term of this patent is extended or adjusted under 35 U.S.C. 154(b) by 108 days.

(21) Appl. No.: 17/392,681

(22) Filed: Aug. 3, 2021

(65) Prior Publication Data

US 2023/0045355 A1 Feb. 9, 2023

(51) Int. Cl.

| | |
|---|---|
| ***B41F 16/00*** | (2006.01) |
| ***B30B 1/04*** | (2006.01) |
| ***B30B 15/06*** | (2006.01) |
| ***B30B 15/14*** | (2006.01) |
| ***B41F 1/38*** | (2006.01) |
| ***B41F 33/00*** | (2006.01) |

(52) U.S. Cl.

CPC ..... *B41F 16/0046* (2013.01); *B30B 1/04* (2013.01); *B30B 15/064* (2013.01); *B30B 15/148* (2013.01); *B41F 1/38* (2013.01); *B41F 33/0009* (2013.01)

(58) Field of Classification Search

CPC .. B41F 33/0009; B41F 33/02; B41F 16/0046; B41F 16/02; B41F 1/02; B30B 1/04; B30B 1/064; B30B 15/064

See application file for complete search history.

(56) References Cited

U.S. PATENT DOCUMENTS

| | | | | |
|---|---|---|---|---|
| 3,923,590 | A * | 12/1975 | Humphries | B30B 15/34 156/583.9 |
| 3,979,248 | A * | 9/1976 | Kussmaul | G05G 15/08 156/359 |
| 4,058,055 | A * | 11/1977 | Douglas | D06B 11/0076 101/10 |
| 5,474,633 | A * | 12/1995 | Myers | B41F 16/00 156/583.8 |
| 7,963,219 | B2 | 6/2011 | Robinson | |
| 9,038,690 | B1 | 5/2015 | Hsiao et al. | |

(Continued)

FOREIGN PATENT DOCUMENTS

| | | | |
|---|---|---|---|
| WO | 9522452 | A1 | 8/1995 |
| WO | 2019028135 | A1 | 2/2019 |

OTHER PUBLICATIONS

Extended European Search Report dated Dec. 12, 2022 for copending European Patent App. No. EP22188284.8.

*Primary Examiner* — Katrina M Stransky
*Assistant Examiner* — P Derek Pressley
(74) *Attorney, Agent, or Firm* — Fishman Stewart PLLC

(57) ABSTRACT

A heat press includes a base, a handle, a heater arm, a controller, a lower platen, and an upper platen. The handle is pivotally coupled to the base. The heater arm is pivotally coupled to the base. The controller is pivotally coupled to the handle and the heater arm such that the controller pivots from a first position to a second position during a pivotal movement of the handle from an open position to a closed position. The lower platen is connected to base. The upper platen is connected to the heater arm. A surface of the upper platen is separated from a surface of the lower platen in the open position. The surface of the upper platen is in contact with the surface of the lower platen in the closed position.

13 Claims, 5 Drawing Sheets

(56) References Cited

U.S. PATENT DOCUMENTS

| | | | | |
|---|---|---|---|---|
| 2015/0321463 | A1 | 11/2015 | Robinson | |
| 2016/0250816 | A1* | 9/2016 | Robinson | B30B 15/0029 100/35 |
| 2018/0250928 | A1 | 9/2018 | Schmidt et al. | |
| 2019/0184667 | A1 | 6/2019 | Cao | |
| 2019/0263109 | A1 | 8/2019 | Richards et al. | |
| 2020/0324542 | A1 | 10/2020 | Lin et al. | |
| 2022/0040947 | A1 | 2/2022 | Mombourquette | |

* cited by examiner

POP UP CONTROLLER FOR HEAT PRESS

TECHNICAL FIELD

The exemplary illustrations described herein are generally directed to presses, such as heat transfer presses that include platens.

BACKGROUND

Heat applied transfers include a variety of indicia with inks, material layers, and adhesives that become bonded to material layers, for example, apparel such as shirts, jackets, or the like, upon pressurized contact and heating of the transfers and apparel between press platens. Graphic images and lettering may generally be accurately and quickly transferred to the apparel without bleeding or partial interruptions in the bonding of the transfer, as long as the presses can be operated at a predetermined temperature for a predetermined time and at a predetermined pressure.

The presses must be able to accommodate many variations in the arrangement of transfers and apparel, as well as the types of transfers and apparel materials available. Moreover, the presses accommodate a wide variety of temperatures, pressures, and time intervals associated with application of indicia to a garment. Due to the desire for flexibility and economic factors, presses have traditionally been manually operated, i.e., they often rely on a user (e.g., an operator) to control at least (a) the force applied through the platens and (b) the length of time the force is applied with a mechanical apparatus.

The accuracy and precision of the temperature, and the pressure and the time duration for which these parameters are applied to the transfers, are particularly important to complete an efficient bonding of the transfers to materials and can be difficult to accomplish in an accurate and repeatable manner. The foregoing parameters are set and/or controlled via a heat press controller. Often, the heat press controllers are not viewable by the user during certain portions of the heat transfer process. For example, the user's view of the heat press controller may be blocked by a portion of the heat press when the heat press is opened and/or closed. Accordingly, there remains a need for an improved heat press.

BRIEF DESCRIPTION OF THE DRAWINGS

While the claims are not limited to a specific illustration, an appreciation of the various aspects is best gained through a discussion of various examples thereof. Referring now to the drawings, exemplary illustrations are shown in detail. Although the drawings represent the illustrations, the drawings are not necessarily to scale and certain features may be exaggerated to better illustrate and explain an innovative aspect of an example. Further, the exemplary illustrations described herein are not intended to be exhaustive or otherwise limiting or restricted to the precise form and configuration shown in the drawings and disclosed in the following detailed description.

DETAILED DESCRIPTION

Figure 1:
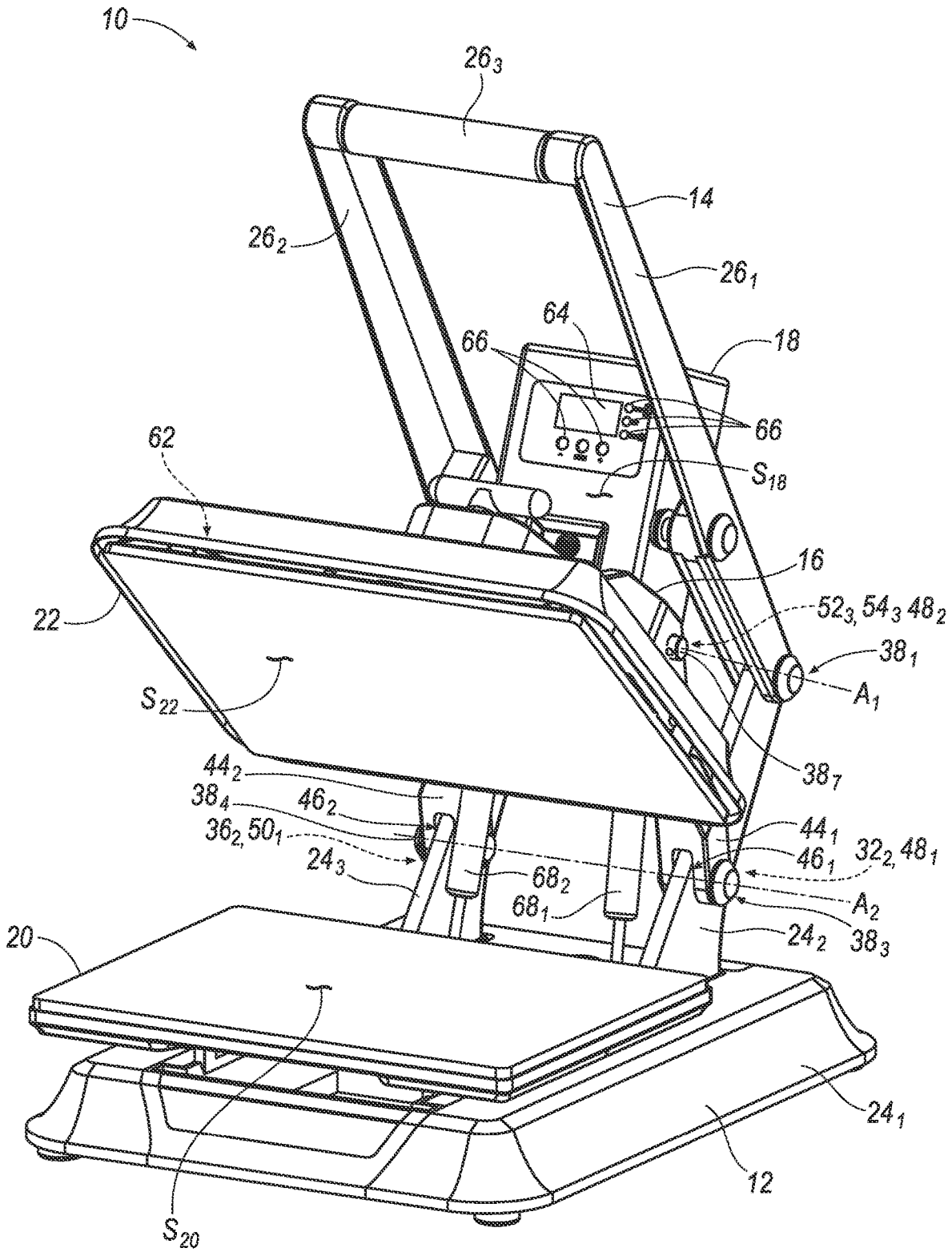
FIG. 1 illustrates a perspective view of an exemplary press in an open position.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

Various exemplary illustrations are provided herein of exemplary presses, e.g., for applying indicia to garments by application of heat. According to one exemplary illustration, a press may include an upper platen, and a lower platen disposed below and generally aligned with the upper platen. The press may be adapted to move the upper platen between an open position, wherein the upper and lower platens are spaced away from one another, and a closed position, wherein the upper platen is pressed against the lower platen.

A heat press may include a base, a handle, a heater arm, a controller, a lower platen, and an upper platen. The handle may be pivotally coupled to the base. The heater arm may be pivotally coupled to the base. The controller may be pivotally coupled to the handle and the heater arm such that the controller pivots from a first position to a second position during a pivotal movement of the handle from an open position to a closed position. The lower platen may be connected to base. The upper platen may be connected to the heater arm. A surface of the upper platen may be separated from a surface of the lower platen in the open position. The surface of the upper platen may be in contact with the surface of the lower platen in the closed position.

Exemplary illustrations are described in detail below. General discussion applies to all the figures as follows, with discussion specific to each figure later provided.

Referring generally to the figures, an exemplary heat press 10 is shown according to the disclosure. The heat press 10 may include a base 12, a handle 14, a heater arm 16, a controller 18, a lower platen 20, and/or an upper platen 22. In some example configurations, the base 12 may include a first portion $\mathbf{24}_1$, a second portion $\mathbf{24}_2$, and/or a third portion $\mathbf{24}_3$. The second portion $\mathbf{24}_2$ and/or the third portion $\mathbf{24}_3$ may extend from the first portion $\mathbf{24}_1$. The second portion $\mathbf{24}_2$ may be spaced apart from the third portion $\mathbf{24}_3$. In some examples, the second portion $\mathbf{24}_2$ and the third portion $\mathbf{24}_3$ may include geometries (e.g., shapes) that are substantially similar.

In some example configurations, the handle 14 may be pivotally coupled to the base 12. In some examples, the handle 14 may include a first portion $\mathbf{26}_1$ spaced apart from a second portion $\mathbf{26}_2$, and/or a third portion $\mathbf{26}_3$ extending between and/or connecting the first portion $\mathbf{26}_1$ and the second portion $\mathbf{26}_2$. In some instances, the first portion $\mathbf{26}_1$ and the second portion $\mathbf{26}_2$ may include geometries that are substantially similar (e.g., elongated). In some examples, the first portion $\mathbf{26}_1$ of the handle 14 may be pivotally coupled to the second portion $\mathbf{24}_2$ of the base 12 and/or the second portion $\mathbf{26}_2$ of the handle 14 may be pivotally coupled to the third portion $\mathbf{24}_3$ of the base 12.

In this regard, the first portion $\mathbf{26}_1$ of the handle 14 may include a first clevis $\mathbf{28}_1$ and/or the second portion $\mathbf{26}_2$ of the handle 14 may include a second clevis $\mathbf{28}_2$. The second portion $\mathbf{24}_2$ of the base 12 may be at least partially disposed within the first clevis $28_1$, such that portions of the first portion $26_1$ of the handle 14 may be disposed on either side of the second portion $24_2$ of the base 12. The third portion $24_3$ of the base 12 may be at least partially disposed within the second clevis $28_2$, such that portions of the second portion $26_2$ of the handle 14 may be disposed on either side of the third portion $24_3$ of the base 12.

In some examples, the first portion $26_1$ of handle 14 may include a through hole $30_1$ that may be aligned with a through hole $32_1$ of the second portion $24_2$ of the base 12 and/or the second portion $26_2$ of handle 14 may include a through hole $34_1$, that may be aligned with a through hole $36_1$ of the third portion $24_3$ of the base 12. In some examples, a first coupler $38_1$ including a bolt 40 (e.g., a pin, a rod, a screw, among others) and a fastener 42 (e.g., a nut, etc.) may be disposed, at least partially, within the through holes $30_1$, $32_1$, and/or the first clevis $28_1$. A second coupler $38_2$ may be disposed, at least partially, within the through holes $34_1$, $36_1$, and/or the second clevis $28_2$. In some example configurations, the first coupler $38_1$ and/or the second coupler $38_2$ may be configured to, at least in part, pivotally couple the handle 14 to the base 12, such that the handle 14 rotates relative to the base 12 about a first axis A1.

In some implementations, the heater arm 16 may be pivotally coupled to the base 12. The heater arm 16 may include a first portion $44_1$ and/or a second portion $44_2$. The first portion $44_1$ and the second portion $44_2$ may include substantially similar geometries. In some examples, the first portion $44_1$ of the heater arm 16 may be pivotally coupled to the second portion $24_2$ of the base 12 and/or the second portion $44_2$ of the heater element 16 may be pivotally coupled to the third portion $24_3$ of the base 12.

In this regard, the first portion $44_1$ of the heater arm 16 may include a first clevis $46_1$ and/or the second portion $44_2$ of the heater arm 16 may include a second clevis $46_2$. The second portion $24_2$ of the base may be at least partially disposed with the first clevis $46_1$, such that portions of the first portion $44_1$ of the heater arm 16 may be disposed on either side of the second portion $24_2$ of the base. The third portion $24_3$ of the base 12 may be at least partially disposed within the second clevis $46_2$, such that portions of the second portion $44_2$ of the heater arm 16 may be disposed on either side of the third portion $24_3$ of the base 12.

In some examples, the first portion $44_1$ of the heater arm 16 may include a through hole $48_1$ that be aligned with an additional through hole $32_2$ of the second portion $24_2$ of the base 12 and/or the second portion $44_2$ of heater arm 16 may include a through hole $50_1$, that may be aligned with an additional through hole $36_2$ of the third portion $24_3$ of the base 12. In some examples, a third coupler $38_3$ may be disposed, at least partially, within the through holes $48_1$, $32_2$, and/or the first clevis $46_1$. A fourth coupler 384 may be disposed, at least partially, within the through holes $50_1$, $36_2$, and/or the second clevis $46_2$. In some example configurations, the third coupler $38_3$ and/or the fourth coupler 384 may be configured to, at least in part, pivotally couple the heater arm 16 to the base 12, such that the heater arm 16 rotates relative to the base 12 about a second axis A2. In some instances, the second axis A2 may extend in a direction that may be substantially parallel to the first axis A1.

In some example configurations, the controller 18 may be pivotally coupled to the handle 14 and/or the heater arm 16. In some examples, the controller 18 may include a plurality of brackets 52, such as a first bracket $52_1$, a second bracket $52_2$, a third bracket $52_3$, and/or a fourth bracket $52_4$. The plurality of brackets 52 may be detachably coupled to the controller 18. In some examples, the first bracket $52_1$ and the second bracket $52_2$ may be pivotally coupled to the handle 14, and/or the third bracket $52_3$ and the fourth bracket $52_4$ may be pivotally coupled to the heater arm 16. In some instances, the first bracket $52_1$ and the second bracket $52_2$ may include geometries (e.g., shapes) that are substantially similar, and/or the third bracket $52_3$ and the fourth bracket $52_4$ may include geometries that are substantially similar.

In some implementations, the first bracket $52_1$ may include a first through hole $54_1$ that may be aligned with an additional through hole $30_2$ of the first portion $26_1$ of the handle 14, and/or the second bracket $52_2$ may include a second through hole $54_2$ that may be aligned with an additional through hole $34_2$ of the second portion $26_2$ of the handle 14. In some examples, a fifth coupler $38_5$ may be disposed, at least partially, within the through holes $54_1$, $30_2$, and/or a sixth coupler $38_6$ may be disposed, at least partially within the through holes $54_2$, $34_2$.

In some implementations, the third bracket $52_3$ may include a third through hole $54_3$ that may be aligned with an additional through hole $48_2$ of the first portion $44_1$ of the heater arm 16, and/or the fourth bracket $52_4$ may include a fourth through hole $54_4$ that may be aligned with an additional through hole $50_2$ of the second portion $44_2$ of the heater arm 16. In some examples, a seventh coupler $38_7$ may be disposed, at least partially, within the through holes $54_3$, $48_2$, and/or a eighth coupler $38_8$ may be disposed, at least partially within the through holes $54_4$, $50_2$.

In some example configurations, the fifth coupler $38_5$ and/or the sixth coupler $38_6$ may be configured to, at least in part, pivotally couple the controller 18 to the handle 14, such that the controller 18 rotates about a third axis A3. The seventh coupler $38_7$ and/or the eight coupler $38_8$ may be configured to, at least in part, pivotally couple the controller 18 to the heater arm 16, such that the controller 18 rotates about a fourth axis A4. In some instances, the first axis A1, the second axis A2, the third axis A3, and/or the fourth axis A4 may extend in directions that are substantially parallel. In some examples, the heater arm 16 may be coupled to the handle 14 via the controller 18.

In some implementations, the lower platen 20 may be fixed directly (e.g., screwed, fastened, etc.) to the base 12. In some instances, the lower platen 20 may be fixed directly to the first portion $24_1$ of the base 12. In some example configurations, the upper platen 22 may be coupled to the heater arm 16. In some instances, the upper platen 22 may be coupled to the heater arm 16 via an adjustment component 56. The adjustment component 56 may include a threaded portion 58 connected to a handle 60. The adjustment component 56 may be configured to move the upper platen 22 closer to and/or further away from the heater arm 16. In this regard, an operator of the heat press 10 may rotate the handle 60 about a fifth axis A5 which may move the upper platen 22 relative to the heater arm 16.

In some example configurations, a heater 62 may be disposed within at least one of the lower platen 20 and/or the upper platen 22. In some examples, the heater 62 may be disposed within the upper platen 22. In some examples, the heater 62 may be disposed within the lower platen 20. In some instances, the heater 62 may include conventional electrically resistive heating elements and the like, which may be formed as serpentine or otherwise wound throughout surface areas of the upper platen 22 and/or the lower platen 22.

The heater 62 may be coupled to a typical power supply (not depicted) through a switch and/or a controller and may be configured for adjusting the temperature of heater 62, e.g., by way of the controller 18. The temperature of the heater 62 may be adjusted by adjusting power to the heat elements. In some instances, the upper platen 22 and/or the lower platen 20 may carry a thermo-couple sensor, RTD probe, NTC thermistor or similar device (not shown) which may be wired in a conventional manner to generate temperature information for the controller 18, which displays information (e.g., heat press parameters) via a display 64 and/or a controller readout. The display 64 may be disposed on a viewing surface $S_{18}$ of the controller 18, such that the display 64 is viewable by an operator (e.g., a user) of the heat press 10. An electrical circuit for the heater 62 may also include a temperature control such as a thermostat.

In some implementations, the controller 18 may generally include computational and/or control elements (e.g., a microprocessor and/or a microcontroller). The controller 18 may be electrically connected to the heater 62. The controller 18 may generally provide time monitoring, temperature monitoring, pressure monitoring, and control, as examples. The display 64 of the controller 18 may further include various readout displays, e.g., to allow display of a force, temperature, or time associated with operation of the heat press 10. In some examples, the display 64 may allow for manipulation of the controller 18 by an operator, e.g., by way of a touchscreen interface (not shown). In some examples, the controller 18 may include input capabilities, to set time, temperature, and the like, via for instance, a touch screen or via push buttons 66, as examples.

In some instances, the heat press 10 may include a first shock $\mathbf{68}_1$ and/or a second shock $\mathbf{68}_2$. In some examples, the first shock $\mathbf{68}_1$ and/or the second shock $\mathbf{68}_2$ may be connected to the base 12 and the heater arm 16. In this regard, the first shock $\mathbf{68}_1$ may be connected to the second portion $\mathbf{26}_2$ of the base 12 and the first portion $\mathbf{44}_1$ of the heater arm, and/or the second shock $\mathbf{68}_2$ may be connected to the third portion $\mathbf{26}_3$ of the base 12 and the second portion $\mathbf{44}_2$ of the heater arm 16. The first shock $\mathbf{68}_1$ and/or the second shock $\mathbf{68}_2$ may be configured to counterbalance (e.g., dampen the movement of) the upper platen 22 (e.g., when the upper platen 22 includes the weight of the heater 62) when the operator manipulates (e.g., pivotal move the handle 14 to move the upper platen 22. The first shock $\mathbf{68}_1$ and/or the second shock $\mathbf{68}_2$ may include gas springs and/or other conventional shocks.

Figure 2:
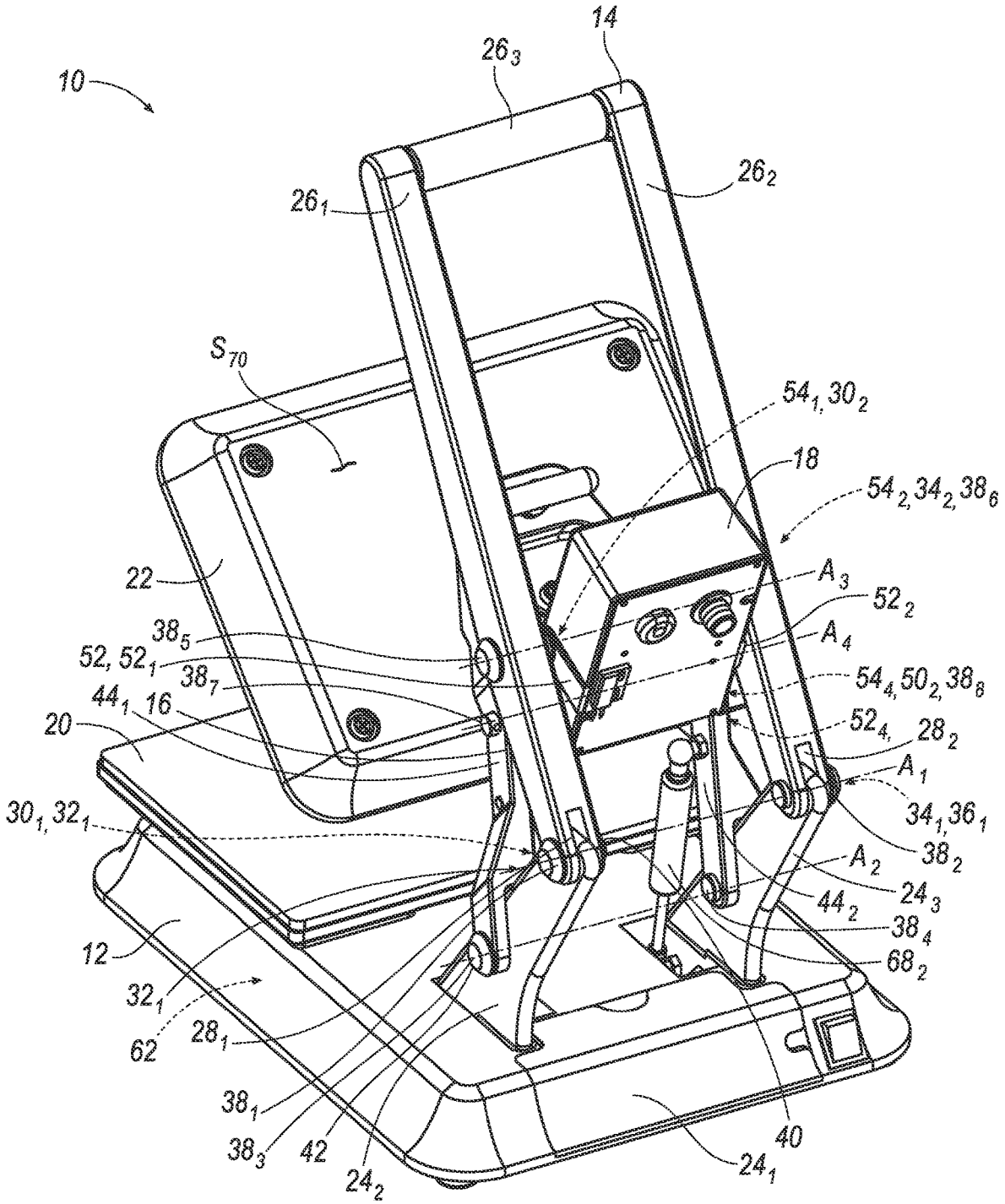
FIG. 2 illustrates a perspective view of an exemplary press in an open position.
Figure 3:
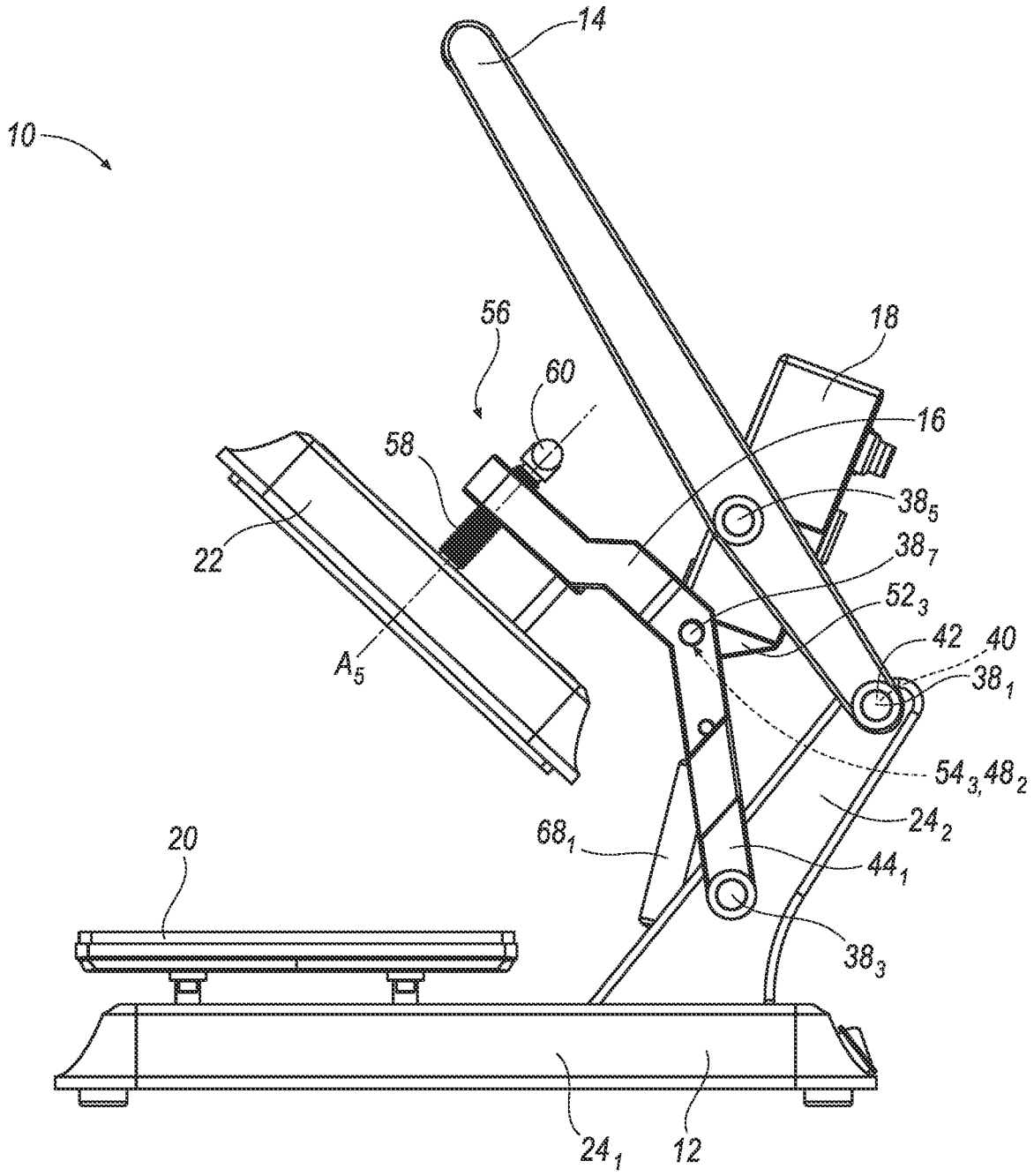
FIG. 3 illustrates a side view of an exemplary press in an open position.

Referring now to FIGS. 1-3, the heat press 10 is shown in an open position. When the heat press 10 is in the open position, an engagement surface $S_{22}$ of the upper platen 22 may be separated from an engagement surface $S_{20}$ of the lower platen 20. In some examples, when the heat press 10 is in the open position, the controller 18 may be in a first position. For example, when in the controller 18 is in the first position a viewing surface $S_{18}$ of the controller 18 may be disposed at an angle (e.g., 0 to 180 degrees) relative to an upper surface $S_{70}$ of the upper platen 22, such that an operator of the heat press 10 may have an unobstructed view of the controller 18 (e.g., the display 64 of the controller 18 and/or the push buttons 66 of the controller 18).

Figure 4:
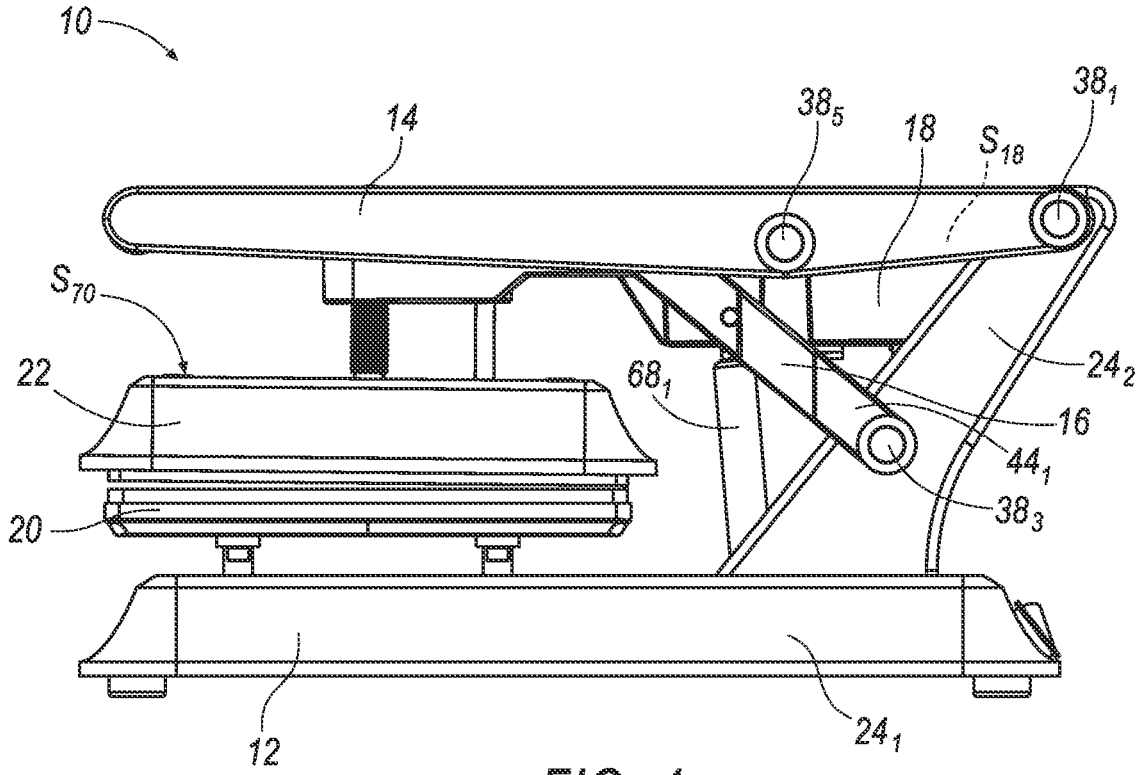
FIG. 4 illustrates a side view of an exemplary press in a closed position.
Figure 5:
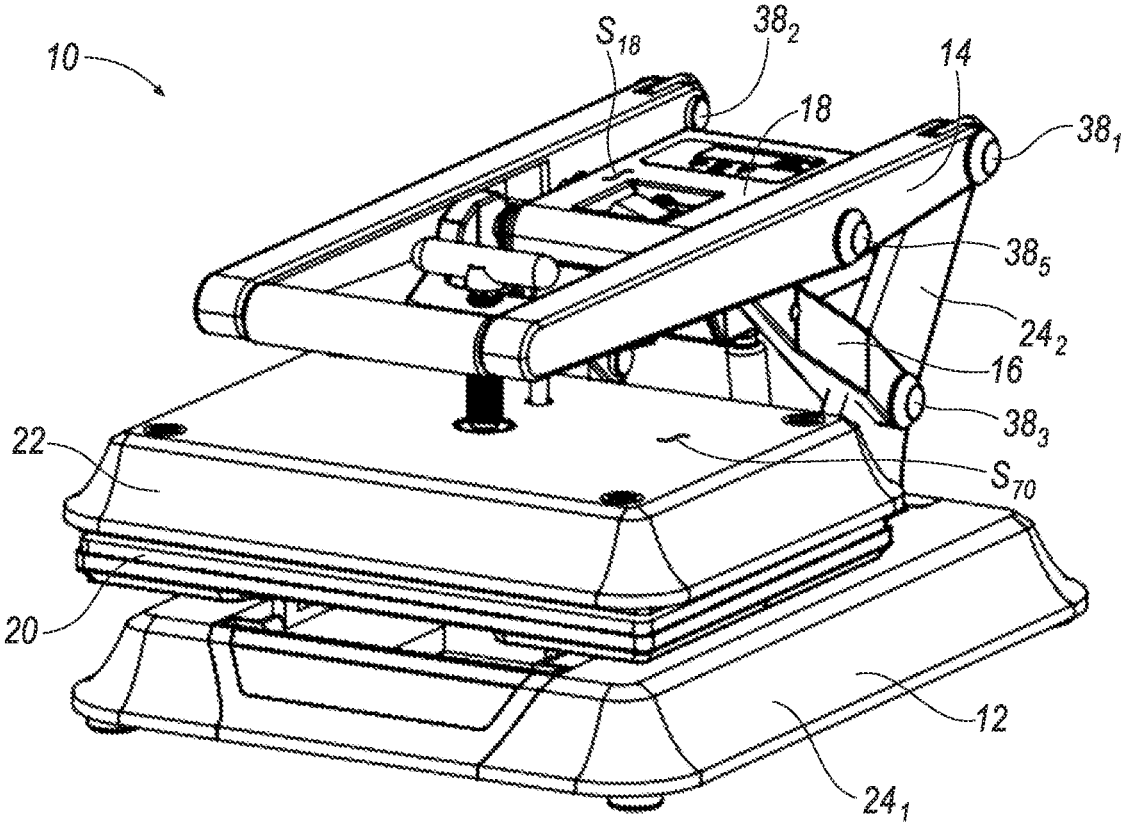
FIG. 5 illustrates a perspective view of an exemplary press in a closed position.

Referring now to FIGS. 4-5, the heat press 10 is shown in a closed position (e.g., a second position). In the closed position, the engagement surface $S_{22}$ of the upper platen 22 may be in contact with (e.g., engage) the engagement surface $S_{20}$ of the lower platen 20. In some examples, when the heat press 10 is in the closed position, the controller 18 may be in a second position. For example, when the controller 18 is in the second position, the viewing surface $S_{18}$ of the controller 18 may be disposed substantially parallel to the upper surface $S_{70}$ of the upper platen 22. In some instances, when the controller 18 is in the second position, the viewing surface $S_{18}$ may be disposed between and/or below the first portion $\mathbf{26}_1$ and the second portion $\mathbf{26}_2$ of the handle 14. When the controller 18 is the second position, the operator may have an unobstructed view of the controller 18 (e.g., the display 64 of the controller 18 and/or the push buttons 66 of the controller 18).

In some implementation, manipulation (e.g., pivotal movement) of the handle 14 may cause the controller 18 to simultaneously move (e.g., from the first position to the second position), such that operator has a continuously unobstructed view of the controller 18 (e.g., the display 64 of the controller 18 and/or the push buttons 66 of the controller 18) during the entire operation of the heat press 10. For example, when the operator manipulates the handle 14, the controller 18 and the upper platen 22 may simultaneously move. In this regard, when the operator manipulates the handle 14, the handle 14 will rotate relative to the base 12 about the first axis A1. The controller 18 will rotate relative to the handle 14 about the third axis A3, and/or the controller 18 will rotate relative to the heater arm 16 about the fourth axis A4. The heater arm 16 will rotate relative to the base 12 about the second axis A2, which may cause the upper platen 22 to move relative to the lower platen 20.

In some example configurations, the heat press 10 may include a low profile. As such, the heat press 10 may be able to operate in a variety of tight environments due to its low profile. The disclosed subject matter therefore includes minimal gap between the upper platen 22 (e.g., when the heater 62 is disposed within the upper platen 22) and the heater arm 16 (e.g., all the compliance structure is under the platen 22 where more space for garment clearance is beneficial, instead of above the heater 62). The handle 14 positions maintain low profile (i.e., the handle 14 does not stick straight up making it more difficult to store).

In some examples, the heat press 10 may include a total height of approximately 9", a width of approximately 13", a depth of approximately 18", a platen height of approximately 4", and a clearance around the platen of approximately 2". This is in contrast to known heat presses that occupy a larger profile or volume (e.g., bulky) and are generally much taller. The low profile or volume is obtained due to, at least in part, the compact nature of engagement of the base 12 with the lower platen 20. In addition, the overall package height is minimized due to the additional impact of the handle 14 and its operation to raise and lower the upper platen 22.

Known heat presses typically include both a controller and a four-bar linkage, which links the handle to the base and via at least one intermediate linkage. Thus, according to the disclosure, these functions are combined and a controller (e.g., controller 18) also serves as a linkage. That is, where two components may be used in known devices, only one component is now used according to the disclosure. Not only does this reduce the number of components, but it also results in a compact arrangement and the controller 18 is captured within the profile of the heat press 10 when it is closed, convenient for both operation and for moving the heat press 10 from location to location. Also, the controller 18 is still accessible for operation and changing settings, etc., when closed, but also conveniently pivots when the heat press 10 is opened, conveniently facing the operator and allowing settings to be changed when the heat press 10 is in the open position as well.

Thus, according to the disclosure and as illustrated in the drawings, a heat press 10 includes a base 12, a handle 14, a heater arm 16, a controller 18, a lower platen 20, and an upper platen 20. The handle 14 is pivotally coupled to the base 12. The heater arm 16 is pivotally coupled to the base 12. The controller 18 is pivotally coupled to the handle 14 and the heater arm 16 such that the controller 18 pivots from a first position to a second position during a pivotal movement of the handle 14 from an open position to a closed position. The lower platen 20 is connected to base 12. The upper platen 22 is connected to the heater arm 16. A surface $S_{22}$ of the upper platen 22 is separated from a surface $S_{20}$ of the lower platen 20 in the open position. The surface $S_{22}$ of the upper platen 22 is in contact with the surface $S_{20}$ of the lower platen 22 in the closed position Additionally, according to the disclosure, and as illustrated in the drawings, a method of fabricating a heat press 10 includes attaching a lower platen 20 to a base 12, attaching a heater arm 16 to the base 12, attaching a handle 14 to the base 12, coupling a controller 18 to the heater arm 16 and the handle 14 such that the controller 18 pivots from a first position to a second position during a pivotal movement of the handle 14 from an open position to a closed position, and coupling an upper platen 22 to the heater arm 16.

The exemplary illustrations are not limited to the previously described examples. Rather, a plurality of variants and modifications are possible, which also make use of the ideas of the exemplary illustrations and therefore fall within the protective scope. Accordingly, it is to be understood that the above description is intended to be illustrative and not restrictive.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

What is claimed is:

1. A heat press comprises:

a base;

a handle pivotally coupled to the base about a first axis;

a heater arm pivotally coupled to the base about a second axis;

a controller pivotally coupled to the handle about a third axis and to the heater arm about a fourth axis, such that the controller pivots from a first position to a second position during a pivotal movement of the handle from an open position to a closed position;

a heater disposed within at least one of the lower platen and/or the upper platen, the heater electrically connected to the controller;

a lower platen connected to the base; and an upper platen connected to the heater arm;

wherein a surface of the upper platen is separated from a surface of the lower platen in the open position, and the surface of the upper platen is in contact with the surface of the lower platen in the closed position;

wherein the controller pivots out of substantially parallel alignment with the upper platen when the upper platen moves from the closed position to the open position;

wherein the controller is configured to control at least one parameter of the heat press, the controller including:

a viewing surface that is visible to an operator of the heat press during movement of the controller from the first position to the second position;

a display disposed on the viewing surface; and at least one button configured to set the at least one parameter of the heat press; and wherein when the controller is in the first position, the viewing surface of the controller is disposed at an angle relative to an upper surface of the upper platen; and when the controller is in the second position, the viewing surface of the controller is disposed substantially parallel to an upper surface of the upper platen.

2. The heat press of claim 1, wherein the pivotal movement of the handle causes the upper platen to move relative to the lower platen, and wherein the heater is disposed in the upper platen.

3. The heat press of claim 1, wherein the display is configured to show the at least one parameter of the heat press, and wherein the at least one parameter of the heat press includes a temperature of the heater and/or a timer.

4. The heat press of claim 1, wherein the pivotal movement of the handle causes the controller to move such that the display and the at least one button are unobstructed while the controller pivots from the first position to the second position.

5. The heat press of claim 1, wherein the heater arm includes a first portion and a second portion;

the base includes a first portion, a second portion, and a third portion, the second portion and the third portion extend from the first portion; and the first portion of the heater arm is pivotally coupled to the second portion of the base and the second portion of the heater arm is pivotally coupled to the third portion of the base.

6. The heat press of claim 5, wherein the heat press includes:

a first shock connected to the second portion of the base and the first portion of the heater arm; and a second shock connected to the third portion of the base and the second portion of the heater arm.

7. The heat press of claim 6, wherein the first shock and the second shock are configured to dampen a movement of the heater.

8. A method of fabricating a heat press, comprising:

attaching a lower platen to a base;

attaching a heater arm to the base, the heater disposed within at least one of a lower platen and/or an upper platen;

electrically connecting the heater to a controller;

attaching a handle to the base;

coupling the controller to the heater arm and the handle such that the controller pivots from a first position to a second position during a pivotal movement of the handle from an open position to a closed position; and coupling the upper platen to the heater arm such that the controller pivots out of substantially parallel alignment with the upper platen during the pivotal movement from the closed position to the open position;

configuring the controller to control at least one parameter of the heat press, the controller including:

a viewing surface that is visible to an operator of the heat press during movement of the controller from the first position to the second position;

a display disposed on the viewing surface; and at least one button configured to set the at least one parameter of the heat press;

wherein when the controller is in the first position, the viewing surface of the controller is disposed at an angle relative to an upper surface of the upper platen; and when the controller is in the second position, the viewing surface of the controller is disposed substantially parallel to an upper surface of the upper platen.

9. The method of claim 8, further comprising separating a surface of the upper platen from a surface of the lower platen in the open position and contacting the surface of the upper platen with the surface of the lower platen in the closed position.

10. The method of claim 8, further comprising moving the upper platen relative to the lower platen via the pivotal movement of the handle.

11. The method of claim 10, providing at least one shock that is configured to dampen a movement of the heater, wherein the at least one shock is connected to the base and the heater arm.

12. The method of claim 8, further comprising controlling at least one parameter of the heat press with the controller, the at least one parameter of the heat press includes a temperature of the heater and/or a timer, and the display is configured to show the at least one parameter of the heat press.

13. The heat press of claim 1, wherein the first axis, the second axis, the third axis, and the fourth axis extend in directions that are substantially parallel to each other.

* * * * *